United States Patent [19]

White et al.

[11] 4,403,441

[45] Sep. 13, 1983

[54] MEAL BOX ASSEMBLY

[76] Inventors: David L. White; Beverly A. White, both of 7777 Mohrle, Fowlerville, Mich. 48836

[21] Appl. No.: 284,942

[22] Filed: Jul. 20, 1981

[51] Int. Cl.[3] ..... A63H 33/00

[52] U.S. Cl. ..... 46/11

[58] Field of Search ..... 46/11, 221, 222, 223

[56] References Cited

U.S. PATENT DOCUMENTS 1,572,141 2/1926 Hildebrandt et al. ..... 46/11
3,246,420 4/1966 Douglas ..... 46/11
3,702,675 11/1972 Bajo ..... 46/11
3,883,983 5/1975 Coster ..... 46/17

FOREIGN PATENT DOCUMENTS 593971 10/1947 United Kingdom ..... 46/17

*Primary Examiner*—F. Barry Shay
*Attorney, Agent, or Firm*—Charles W. Chandler

[57] ABSTRACT

A collapsible meal box having an axle inserted through a pair of openings in the sidewalls of the meal box to prevent the base of the meal box from being moved between the sidewalls into the meal box interior, and thereby prevent the meal box from being collapsed. A pair of wheels are mounted on the axle ends to form an amusement device for children.

4 Claims, 4 Drawing Figures

MEAL BOX ASSEMBLY

BACKGROUND OF THE INVENTION

This invention is related to collapsible meal boxes formed of a paperboard material having a base formed of sections that are folded between the box sidewalls to collapse the meal box, and more particularly to an axle member that is inserted into the meal box and supported adjacent the base to prevent it from being folded into the box while forming a wheeled toy for children.

Some fast food chains employ a collapsible meal box for their customers to carry food from the restaurant. The meal box is usually printed with material that is entertaining to children.

A typical meal box is formed of paperboard with sides that collapse to a position closely adjacent one another. The top and the base are usually formed of several folding sections that interlock when the meal box is expanded. The base sections of certain meal boxes fold to a position within the sidewalls when the box is collapsed. In its expanded position, the weight of the food items on the base prevent it from being collapsed, however, when the meal box is empty, the base sections tend to collapse upwardly into the meal box, thereby limiting its use as a toy.

SUMMARY OF THE INVENTION

The broad purpose of the present invention is to broaden the use of collapsible meal boxes by providing an axle that is received into a pair of aligned openings in the sidewalls of the meal box in a position to prevent the bottom from being collapsed.

A pair of wheels mounted on the ends of the axle provide means for converting the box into a wheeled toy. A hitch element carried on each axle provides means for connecting a series of boxes to form a string of wheeled toys.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
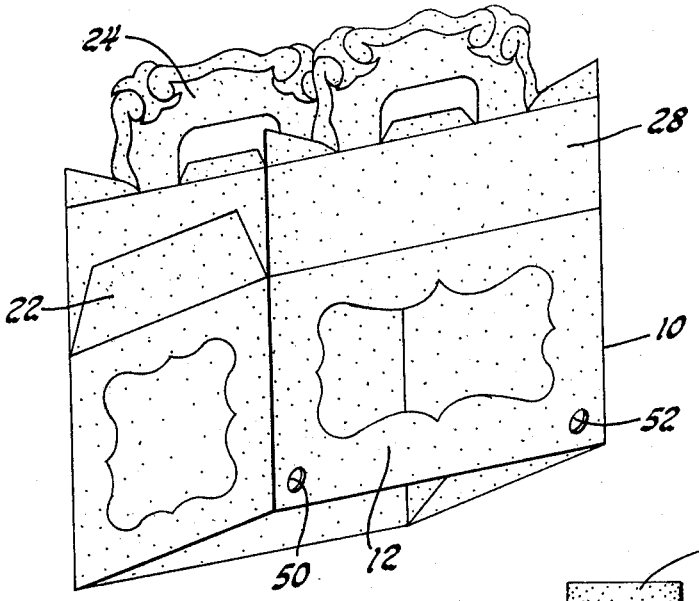
FIG. 1 shows a conventional meal box in a substantially collapsed position.

The drawings illustrate a conventional collapsible meal box 10 formed of a paperboard and having a pair of spaced, parallel sidewalls 12 and 14, a pair of end walls 16 and 18, and a base 20. The sidewalls also have upper flaps 22, 24, 26, and 28 which interlock to form a handle for the box.

Normally the meal boxes are stored and shipped in a collapsed position to reduce the amount of storage space they occupy.

Figure 3:
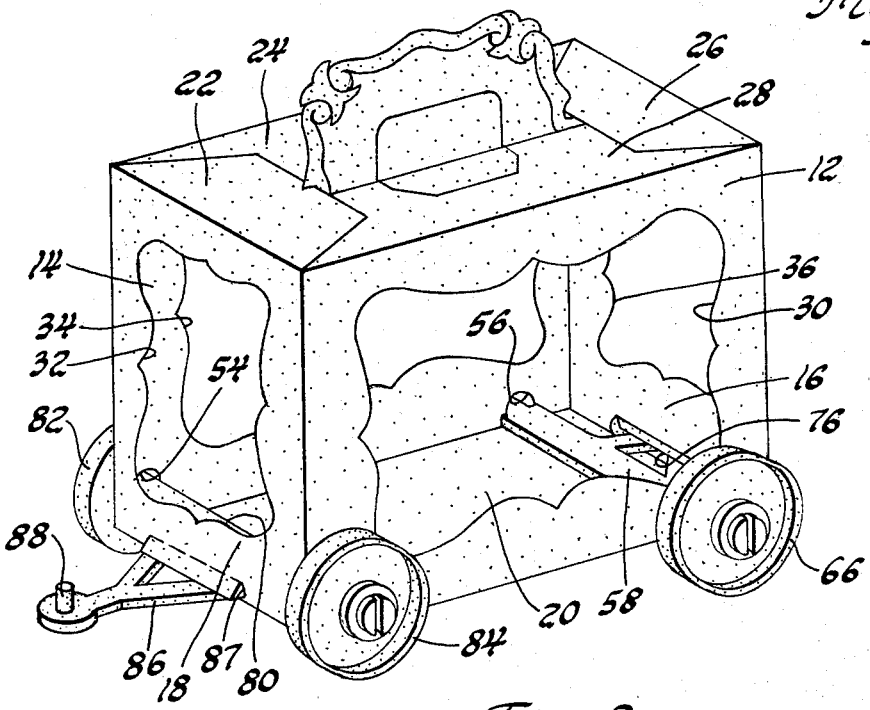
FIG. 3 is a perspective view of the preferred meal box.

The sidewalls have removable mid-sections to form openings 30, 32, 34, and 36, as illustrated in FIG. 3, to form a toy from the meal box when the food has been removed.

Figure 2:
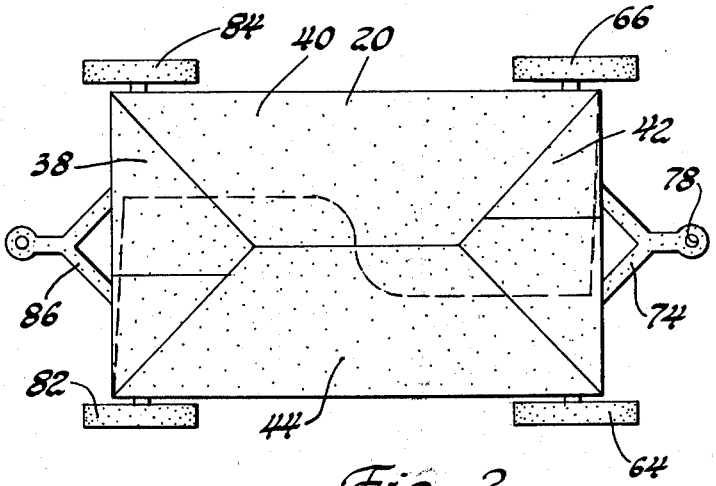
FIG. 2 shows the bottom of the meal box with a pair of axles mounted in accordance with the invention, the hidden portions of the base flaps being illustrated in dotted lines.

Referring to FIG. 2, base 20 is formed of four interlocking flaps 38, 40, 42, and 44. The edges of the flaps fit together such that they form a bottom supporting the meal box contents. The flaps collapse inwardly toward a position between the box sidewalls when the box is being collapsed.

Sidewall 12 has a pair of axle openings 50 and 52 adjacent the base. A second pair of openings 54 and 56, best illustrated in FIG. 3, are aligned with openings 50 and 52, respectively.

An axle 58, formed of plastic, is mounted in the box with its ends extending through openings 52 and 56, as best illustrated in FIG. 3.

Figure 4:
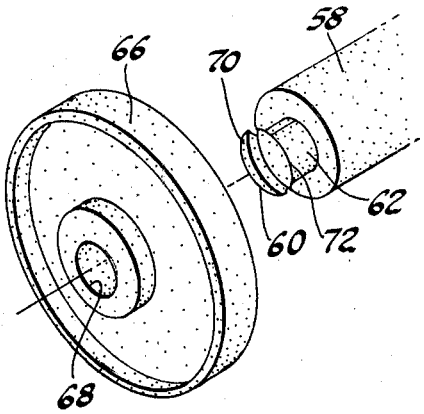
FIG. 4 is a perspective view showing the manner in which the wheels are snapped onto the ends of a typical axle.

Referring to FIG. 4, the outer end of each axle has a pair of resilient fingers 60 and 62. A pair of wheels 64 and 66 are snapped onto each end of the axle. Each wheel has an opening 68. The two resilient fingers on the axle end are passed through the wheel opening where they expand in such a manner that the enlarged ends of the fingers 70 and 72 prevent the wheel from being removed from the axle unless the two fingers are moved toward one another.

A V-shaped hitch 74 is carried by axle 58, and is passed through opening 76 in the end wall of the box. The outer end of the hitch has an opening 78, as illustrated in FIG. 2.

A second axle 80 is mounted in the box with its ends received by openings 50 and 54. Axle 80 has its ends formed in the same manner as axle 58. A pair of wheels 82 and 84, identical to wheel 66, are snapped on the outer ends of axle 80. Axle 80 also carries a V-shaped hitch 86. Hitch 86 passes through opening 87 of the end wall. A finger 88 is carried on the outer end of hitch 86, the finger being receivable through opening 78 of hitch 74. The hitches on each box are basically companion hitches so that a series of boxes can be connected in a string by mating the finger at the rear of one box with the opening in the front of the adjacent box.

It is to be noted that the two axle members are located closely adjacent the base of the box to prevent the flaps that comprise the base from moving into the box and thereby causing the box to collapse. The arrangement is simple to assemble. The user need insert each axle through the interior of the box, passing one end through one opening and the opposite end through the opposite opening while pushing the hitch through its respective opening.

Having described our invention, we claim:

1. A combination comprising:

a collapsible meal box formed of a paperboard and having a base and a pair of spaced parallel sidewalls foldably secured along opposite sides of the base;

means rendering the base movable along a predetermined path of motion upward to a position between said sidewalls as they are moved toward one another to collapse the box;

an elongated axle member, and means supporting the ends of the axle member on the sidewalls of the box such that the axle member is disposed in the path of motion of the base to prevent the sidewalls from being moved one toward the other;

the sidewalls having a pair of aligned openings adjacent the base, the axle member extending through the openings in the sidewalls, and said axle member including means having a diameter larger than said sidewall openings mounted on the ends of the axle member within said box for abutment with the inner surfaces of said sidewalls when said box is in an erected position.

2. A combination as defined in claim 1, in which the ends of the axle members extend beyond the box sidewalls, and including wheel means mounted on said axle member ends.

3. A combination as defined in claim 1, including hitch means carried by the axle member for connecting the box to another similarly formed box.

4. A combination as defined in claim 1, in which the axle member and the hitch form a one piece element.

* * * * *